US005305419A

United States Patent [19]

Cameron

[11] Patent Number: 5,305,419

[45] Date of Patent: * Apr. 19, 1994

[54] HOT WATER TANK CONSTRUCTION, ELECTRICALLY OPERATED HEATING ELEMENT CONSTRUCTION THEREFOR AND METHODS OF MAKING THE SAME

[75] Inventor: Gary J. Cameron, Dayton, Tenn.

[73] Assignee: Robertshaw Controls Company, Richmond, Va.

[ * ] Notice: The portion of the term of this patent subsequent to Apr. 28, 2009 has been disclaimed.

[21] Appl. No.: 944,821

[22] Filed: Sep. 14, 1992

Related U.S. Application Data

[62] Division of Ser. No. 815,826, Dec. 30, 1991, Pat. No. 5,159,659, which is a division of Ser. No. 660,789, Feb. 26, 1991, Pat. No. 5,109,474.

[51] Int. Cl.[5] ..... F24H 1/20

[52] U.S. Cl. ..... 392/501; 392/455; 392/503; 219/548; 338/47

[58] Field of Search ..... 392/501, 455, 503, 457; 219/548; 338/47; 204/400, 404

[56] References Cited

U.S. PATENT DOCUMENTS 3,943,328 3/1976 Cunningham ..... 392/501

*Primary Examiner*—Bruce A. Reynolds
*Assistant Examiner*—John Jeffery
*Attorney, Agent, or Firm*—Candor, Candor & Tassone

[57] ABSTRACT

A hot water tank construction, an electrically operated heating element construction therefor and methods of making the same are provided, the electrically operated heating element construction comprising a heating element and an externally threaded fitting for threading into an internally threaded opening in a wall of the tank, the heating element comprising an outer metallic tubular sheath and an inner conductive heater wire insulated from the sheath, the fitting comprising polymeric material, the heating element construction comprising an electrical resistance electrically interconnected to the sheath and being adapted to electrically interconnect the sheath to the wall of the tank, the polymeric material comprising an electrically conductive polymeric material that also comprises the resistance of the heating element construction.

3 Claims, 4 Drawing Sheets

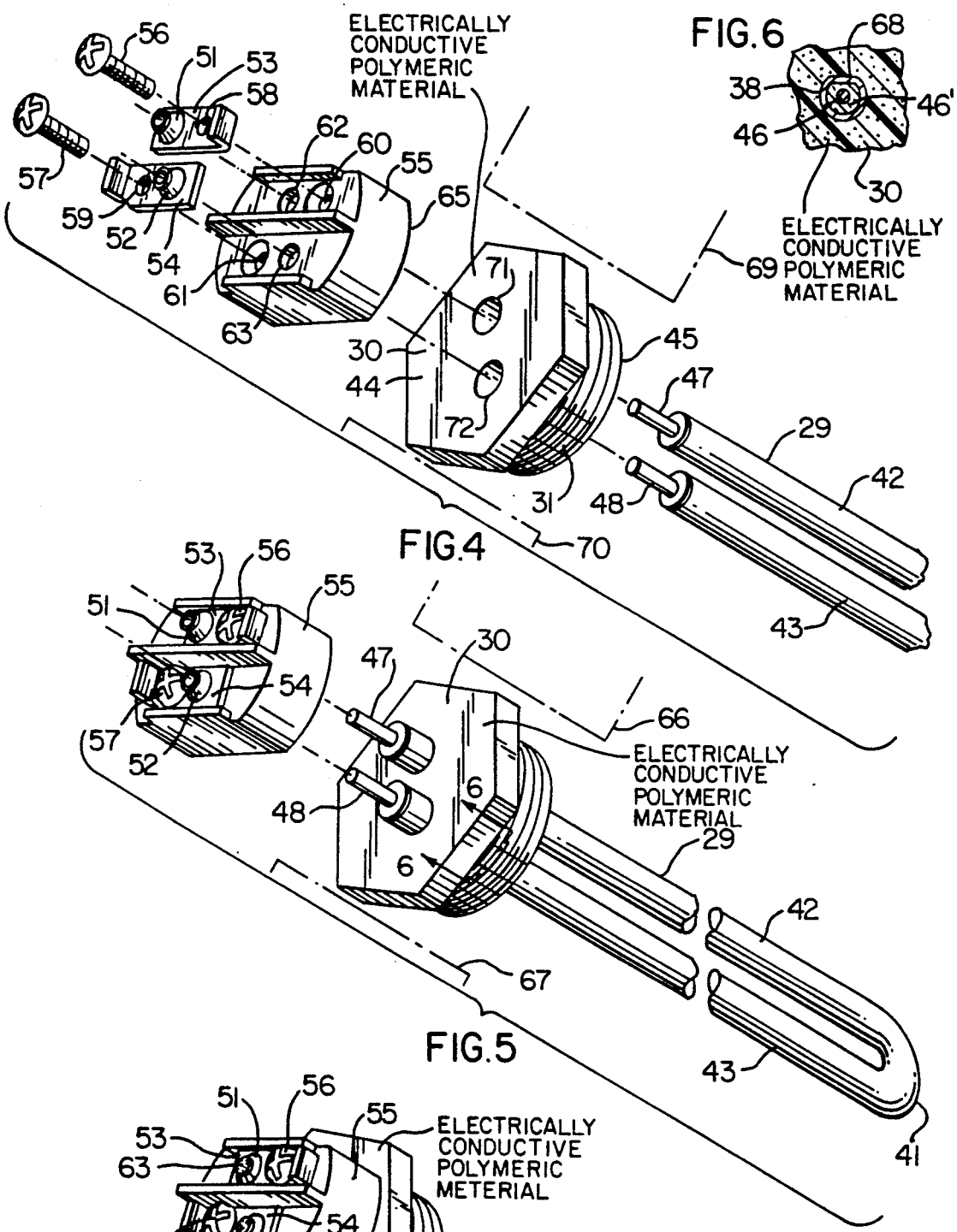
FIG.4
FIG.6
FIG.5
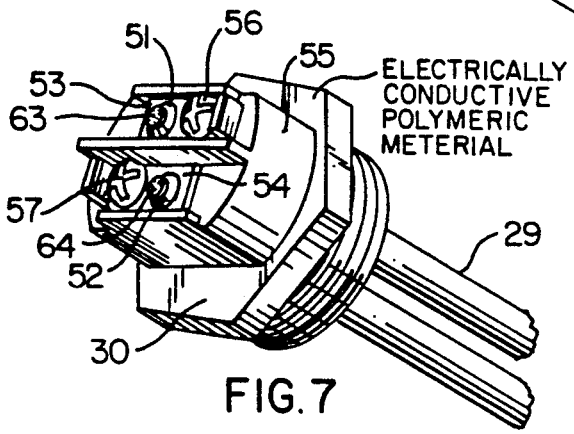
FIG.7

HOT WATER TANK CONSTRUCTION, ELECTRICALLY OPERATED HEATING ELEMENT CONSTRUCTION THEREFOR AND METHODS OF MAKING THE SAME

CROSS REFERENCE TO RELATED APPLICATION

This application is a division patent application of its copending parent patent application, Ser. No. 815,826, filed Dec. 30, 1991, now U.S. Pat. No. 5,159,659, which, in turn, is a division patent application of its copending parent patent application, Ser. No. 660,789, filed Feb. 26, 1991, now U.S. Pat. No. 5,109,474.

BACKGROUND OF THE INVENTION

1. Field of the Invention

This invention relates to a new hot water tank construction and to a new electrically operated heating element construction therefor as well as to a new method of making the new hot water tank construction and to a new method of making the new electrically operated heating element.

2. Prior Art Statement

It is known to provide an electrically operated heating element construction for a hot water tank that has an internally threaded opening means in a wall means thereof, the construction comprising a heating element and an externally threaded fitting for threading into the opening means of the tank, the heating element comprising an outer metallic tubular sheath and an inner conductive heater wire means insulated from said sheath, the fitting comprising polymeric material, the construction comprising electrical resistance means electrically interconnected to the sheath and being adapted to electrically interconnect the sheath to the wall means of the tank, the electrical resistance means comprising an electrical resistance element having electrical lead means that electrically interconnects one end of the resistance element to the sheath of the heating element and having electrical lead means that is adapted to electrically interconnect the other end of the resistance element to the wall means of the tank.

It is also known to provide an electrically operated heating element construction for a hot water tank that has an internally threaded opening means in a wall means thereof, the construction comprising a heating element and an externally threaded fitting for threading into the opening means of the tank, the heating element comprising an outer metallic tubular sheath and an inner conductive heater wire means insulated from the sheath, the fitting comprising polymeric material, the fitting being made separate from the heating element and thereafter being assembled therewith. For example, see the previous paragraph for such a prior known electrically operated heating element construction.

SUMMARY OF THE INVENTION

It is one of the features of this invention to provide a new electrically operated heating element construction for a hot water tank, the construction having unique means for providing electrical resistance means between the metallic sheath of the heating element thereof and the wall means of the tank.

In particular, it is well known that it is desired to provide an electrical resistance connection between the metallic sheath of the heating element of an electrically operated heating element construction and the wall means of a hot water tank that has an internally threaded opening means threadedly receiving an externally threaded fitting of the electrically operated heating element therein, the resistance being an approximately 560 ohms resistance element that has lead means that electrically interconnects one end of that resistance element to the metallic sheath of the heating element and has other lead means that electrically interconnects the other end of that resistance element to the wall means of the tank.

It is believed that such prior known resistance element functions in a manner to provide a potential differential between the sheath of the heating element and the wall of the hot water tank that aids a conventional sacrificial anode disposed in the water of the hot water tank in preventing corrosion of the heating element construction as well as aids in preventing corrosion of the wall means and other parts of the hot water tank.

However, it is believed according to the teachings of this invention that the fitting for the heating element construction can be formed of an electrically conductive polymeric material that will also comprise the desired resistance means of the construction.

For example, one embodiment of this invention provides an electrically operated heating element construction for a hot water tank that has an internally threaded opening means in a wall means thereof, said construction comprising a heating element and an externally threaded fitting for threading into the opening means of the tank, the heating element comprising an outer metallic tubular sheath and an inner conductive heater wire means insulated from the sheath, the fitting comprising polymeric material, the construction comprising electrical resistance means electrically interconnected to the sheath and being adapted to electrically interconnect the sheath to the wall means of the tank, the polymeric material comprising an electrically conductive polymeric material that also comprises the resistance means of the construction.

It is another feature of this invention to provide an electrically operated heating element wherein the assembly of the externally threaded fitting to the heating element is uniquely simplified.

In particular, it was known to provide an externally threaded fitting for an electrically operated heating element by molding polymeric material into the desired shape for the fitting and then assembling that fitting to the heating element.

However, it is believed according to the teachings of this invention that such molded fitting can be directly molded onto the heating element at the same time that the fitting itself is being molded into shape so as to eliminate a subsequent assembly operation.

For example, another embodiment of this invention comprises an electrically operated heating element construction for a hot water tank that has an internally threaded opening means in a wall means thereof, the construction comprising a heating element and an externally threaded fitting for threading into the opening means of the tank, the heating element comprising an outer metallic tubular sheath and an inner conductive heater wire means insulated from the sheath, the fitting comprising polymeric material, the fitting having been molded from the polymeric material directly onto the outer metallic tubular sheath of the heating element.

Accordingly, it is an object of this invention to provide a new electrically operated heating element construction having one or more of the novel features of this invention as set forth above or hereinafter shown or described.

Another object of this invention is to provide a new method of making such a new electrically operated heating element construction, the method of this invention having one or more of the novel features of this invention as set forth above or hereinafter shown or described.

Another object of this invention is to provide a new hot water tank construction having one or more of the novel features of this invention as set forth above or hereinafter shown or described.

Another object of this invention is to provide a new method of making such a new hot water tank construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 4 is an exploded perspective view of the various parts of the electrically operated heating element construction of this invention.

FIG. 5 is a view similar to FIG. 4 and illustrates how the parts of FIG. 4 are being assembled together.

FIG. 6 is a fragmentary cross-sectional view taken on line 6—6 of FIG. 5.

FIG. 7 is a fragmentary perspective view illustrating how the parts of FIG. 5 have been secured together.

DESCRIPTION OF THE PREFERRED EMBODIMENTS

Figure 1:
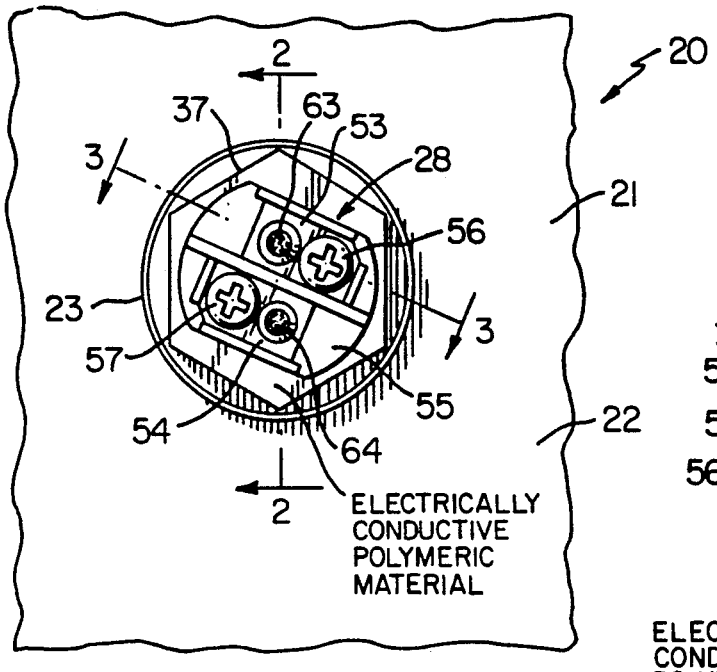
FIG. 1 is a fragmentary front view of the new hot water tank construction of this invention utilizing the new electrically operated heating element construction of this invention.

While the various features of this invention are hereinafter illustrated and described as being particularly adapted to provide an electrically operated heating element construction for a hot water tank, it is to be understood that the various features of this invention can be utilized singly or in various combinations thereof to provide an electrically operated heating element construction for heating other types of apparatus as desired.

Therefore, this invention is not to be limited to only the embodiments illustrated in the drawings, because the drawings are merely utilized to illustrate some of the wide variety of uses of this invention.

Figure 3:
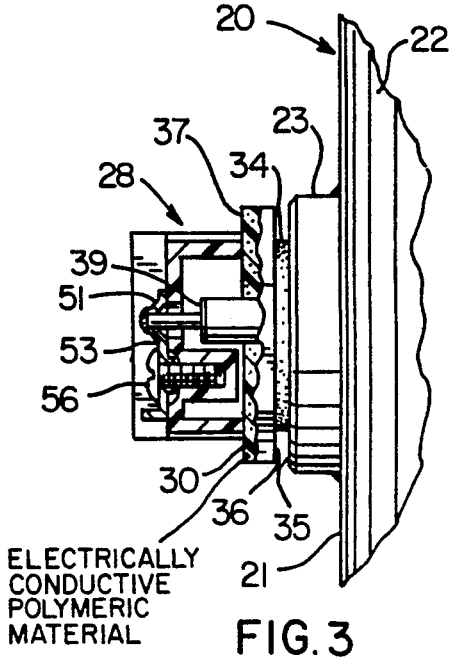
FIG. 3 is a fragmentary side view that is partially in cross section and taken in the direction of the arrows 3—3 of FIG. 1.
Figure 2:
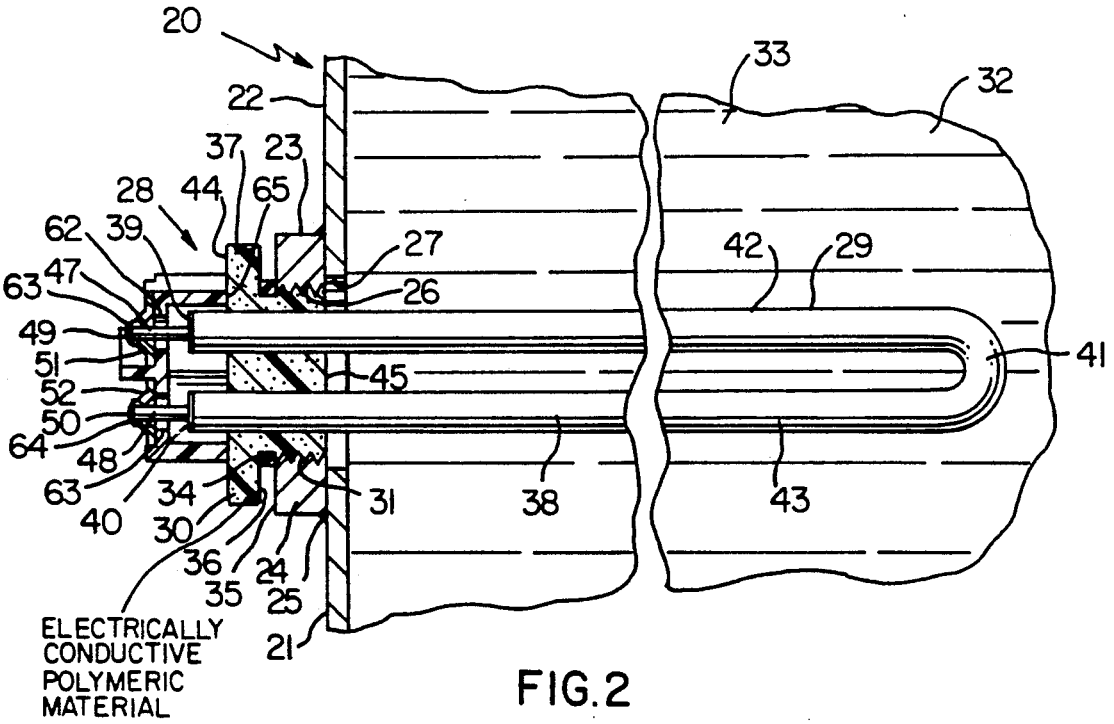
FIG. 2 is a fragmentary cross-sectional view taken on line 2—2 of FIG. 1.
Figure 8:
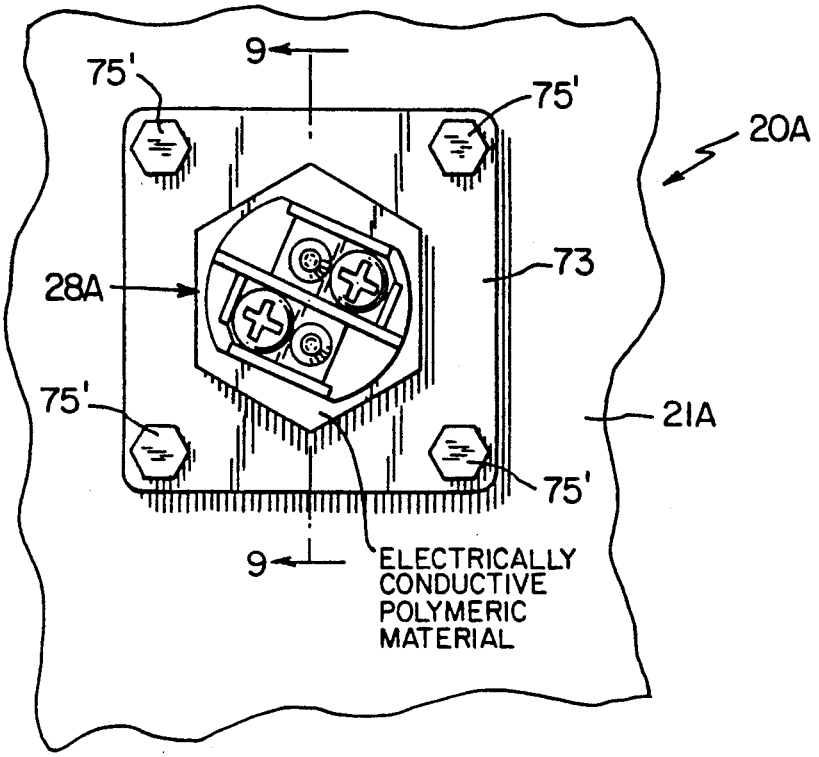
FIG. 8 is a view similar to FIG. 1 and illustrates another new hot water tank construction of this invention utilizing the new electrically operated heating element construction of this invention.

Referring now to FIGS. 1, 2 and 3, the new hot water tank construction of this invention is generally indicated by the reference numeral 20 and comprises a hot water tank 21 comprising wall means 22 formed of any suitable electrically conductive material, such as metallic material, and having an internally threaded opening means 23 that comprises a metallic spud 24 secured to the wall means 22 in any suitable manner, such as by welding 25, and having an internally threaded opening 26 disposed in aligned relation with an opening 27 through the wall means 22 as illustrated in FIG. 2 and in a manner conventional in the art whereby the spud 24 becomes part of the wall means 22 of the tank 21.

The hot water tank construction 20 also comprises an electrically operated heating element construction of this invention that is generally indicated by the reference numeral 28 and comprising a heating element 29 and an externally threaded fitting 30 having an externally threaded portion 31 threaded into the threaded opening 26 of the spud 24 so that the majority of the heating element 29 will be disposed in the water 32 contained within the chamber 33 defined by the wall means 22 of the tank 21 in a manner conventional in the art. An annular resilient sealing gasket 34 is carried on the threaded portion 31 of the fitting 30 and is compressed between a flat surface 35 on the spud 24 and a facing flat surface 36 on a nut-shaped flange portion 37 of the fitting 30 so as to prevent any leakage of the water 32 between the spud 24 and the fitting 30 in a manner well known in the art.

The heating element 29 is conventional in the art and comprises a tubular metallic outer sheath 38 having opposed open ends 39 and 40 and being bent into a suitable shape, such as the U-shape illustrated in FIG. 2, wherein an end yoke portion 41 is provided and two parallel spaced apart portions 42 and 43 leading to the open ends 39 and 40 which are disposed adjacent each other and extend outwardly beyond a front flat side 44 of the flange nut portion 37 of the fitting 30. Thus a majority of the straight parallel portions 42 and 43 extend to the right in FIG. 2 beyond the flat end surface 45 of the externally threaded portion 31 of the fitting 30 as illustrated for heating the water 32 in the tank 21 in a conventional manner.

The fitting 30 of this invention is formed of a conductive polymeric material for a purpose hereinafter set forth and is secured in the desired position on the heating element 29 as illustrated in FIG. 2 in a manner hereinafter set forth whereby the fitting 30 is carried by the heating element 29 and is nonmovable thereon as the fitting 30 and heating element 29 are secured together as will be apparent hereinafter.

The heating element 29 comprises a conductive wire means 46 extending throughout the length of the outer metallic sheath 38 and being insulated therefrom by suitable insulation means 46', FIG. 6, disposed in the sheath 38 in a manner conventional in the art. The wire means 46 comprises a heater wire (not shown) and opposed terminal pin end portions 47 and 48 thereof respectively extending out of the open ends 39 and 40 of the sheath 38 and having the respective ends 49 and 50 thereof projecting into tubular parts 51 and 52 of a pair of conductive terminals 53 and 54 respectively secured to a terminal block 55 by threaded fastening members 56 and 57 respectively passing through threaded openings 58 and 59 in the terminals 53 and 54 and passing into internally threaded openings 60 and 61 in the terminal block 55. The terminal block 55 is made of any suitable electrically insulating material, such as polymeric material, and has a pair of openings 62 and 63 passing therethrough and being in alignment with the tubular portions 51 and 52 of the terminals 53 and 54 and through which the ends 47 and 48 of the conductive wire means 46 pass so that the ends 49 and 50 thereof can be welded to the tubular portions 51 and 52 by the weld means 63 and 64 illustrated in FIGS. 1 and 7 and in a manner conventional in the art.

In this manner, the weld means 63 and 64 not only electrically interconnect the opposed ends 47 and 48 of the wire means 46 to the terminals 53 and 54 and fasten the terminals 53 and 54 to the terminal block 55, but also the weld means 63 and 64 hold the terminal block 55 with its surface 65 in a fixed position against the outwardly facing surface 44 of the fitting 30 as illustrated in FIGS. 1–3 and 7 in a manner conventional in the art whereby a suitable control device (not shown) is adapted to interconnect an electrical power source to the terminals 53 and 54 by having suitable leads electrically interconnected thereto by the fastening means 56 and 57 in a manner conventional in the art. Such a control device is fully disclosed in the McIntosh U.S. Pat. No. 4,736,514, whereby this patent is being incorporated into this disclosure by this reference thereto.

Therefore, since the operation of an electrically operated heating element construction for a hot water tank to tend to maintain the temperature of the water 32 therein at a selected temperature is well known in the art, a further discussion of the reasons for and the operation of an electrically operated heating element construction need not be further set forth.

In the past, when the fitting 30 was formed of metallic material, and the sheath 38 was formed of copper or alloy tube, the fitting 30 and the sheath 38 were zinc or tin plated in order to prevent adverse corrosion thereof during the use of the heater element construction 28 in the water heater tank 21. This may have been because the sheath 38 is directly electrically interconnected to the wall 22 of the tank 21 by the conductive path provided by the prior metallic fitting 30 and the spud 24 so that the conventional sacrificial anode (not shown) being utilized in the chamber 33 of the tank 21 was ineffective in preventing such corrosion unless such tin or zinc plating was utilized.

However, as previously set forth, it is also known to form the fitting of a heating element construction from a polymeric material and then utilizing a resistance element, such as a 560 ohm resistant element, that is carried by the polymeric fitting and has lead means that interconnect one end of the resistance element to the sheath of the heating element and other lead means that interconnect the other end of the resistance element to the spud of the hot water tank. It is believed that by utilizing such resistance element, the zinc or tin plating of the sheath of the heating element is no longer required as such resistance element provides a potential differential to exist between the sheath of the heating element and the wall of the hot water tank that aids the sacrificial anode in preventing corrosion not only of the sheath of the heating element but also of the wall means and other parts of the hot water tank.

It was realized according to the teachings of this invention that to provide such resistance element and the interconnecting lead means with a fitting that is formed of polymeric material requires not only the maintaining of various parts, but also requires various assembly operations and mechanical seals to effect the proper electrical interconnection desired.

Therefore, it is believed according to the teachings of this invention that the fitting 30 can be made of a suitable conductive polymeric material with such conductive polymeric material itself providing the desired electrical resistance between the sheath 38 of the heating element 29 and the wall means 22 of the tank 21 so that not only is plating not necessary for the sheath 38 when the same is formed of copper, but also such resistance prevents the aforementioned corrosion of the heating element 29 and the wall means 22 of the tank 21 in the same manner provided by the separate resistance element for the prior known electrically operated heating element construction.

It is well known that any suitable polymeric material can be made conductive by mixing conductive carbon particles or other conductive particles and/or conductive carbon fibers or other conductive fibers in a certain proportion with the polymeric material to render the structure formed out of such mixture a conductive element. Such a conductive element can be made to have different resistance values between one part thereof and another part thereof depending upon the type, arrangement and/or quantity of conductive carbon parts therein.

Thus, it is believed according to the teachings of this invention that a fitting 30 can be molded from such a conductive polymeric material and will therefore provide a resistive conductive path from the sheath 38 of the heating element 29 to the wall means 22 of the tank 21 when the resultant heating element construction 28 is assembled thereto in the manner illustrated in FIG. 2.

In fact, it is believed according to the teachings of this invention that such conductive polymeric material can be molded into the fitting 30 directly onto the heating element 29 in the manner illustrated in FIG. 5 by conventional injection molding apparatus that is schematically illustrated by the phantom reference lines 66 and 67 in FIG. 5, such injection molding operation causing the polymeric material of the fitting 30 to adhere directly to the sheath 38 of the element 29 so as to be permanently fixed thereon.

However, it is preferred that in addition a mechanical interconnection be provided between the fitting 30 and the sheath 38 of the element 29 during such molding operation and such mechanical interconnection can comprise a flattened or deformed area, such as the flattened deformed area 68 of the sheath 38 as illustrated in FIG. 6, so that such flattened or deformed area 68 will be located inboard of the opposed resulting surfaces 44 and 45 of the resulting fitting 30 so as to prevent the fitting 30 from being pulled off of the sheath 38. Such deformed area 68 can be provided on one or both parallel sections 42 and 43 of the element 29 and can comprise more than one flattened or deformed area for each section 42 or 43 as desired.

While it is preferred to mold the fitting 30 directly onto the heating element 29 in the manner previously set forth, it is to be understood that the fitting 30 could be molded separately from the heating element 29, such as by the injection molding apparatus 69 and 70 of FIG. 4, and then be subsequently assembled therewith by molding opening means 71 and 72 therethrough which will respectively receive the portions 42 and 43 of the heating element 29 therein in the manner illustrated in FIG. 4 with such fitting 30 being force fitted onto the portions 42 and 43 of the heating element 29 as well as being adhesively bonded thereto by a suitable adhesive means, as desired. However, such adhesive means should not prevent a good electrical interconnection between the conductive polymeric fitting 30 and the sheath 38 of the heating element 29.

However, as previously stated it is preferred to directly mold the fitting 30 of conductive polymeric material directly onto the heating element 29 in the manner illustrated in FIG. 5 by the injection molding apparatus 66 and 67 whereby it can be seen that it is a relatively simple operation to form the heating element means 28 of this invention without requiring the separate wiring of a resistance element in place once a polymeric fitting has been formed.

In fact, the prior known polymeric fittings are all separately formed from the heating element, have the resistance element and conductive lead means and mechanical seals added thereto by assembly operations and then the polymeric fitting is attached to the heating element.

Thus, it can be seen that it is only applicant's invention which readily permits a polymeric fitting to be directly molded onto a heating element so as to not only form the polymeric fitting, but also to assemble that polymeric fitting directly onto the heating element 29 in a one-step operation.

Once the electrically operated heating element construction 28 has been formed in the manner previously set forth, the mere threading of the threaded portion 31 thereof in a spud 24 of a hot water tank 21 electrically interconnects that fitting 30 to the wall means 22 of the tank 21 so that the sheath 38 of the heating element 29 is electrically interconnected by the resistance of the fitting 30 to the wall means 22 of the tank for the purpose previously set forth.

In one test embodiment of the heating element construction 28 of this invention, the fitting 30 was formed of a polysulfone having approximately 10% carbon fibers substantially homogeneously disposed therein, such conductive polymeric material being injection molded into the fitting 30 directly onto the heating element 29 with the resultant resistance provided between the sheath 38 and the wall means 22 of the tank being approximately 560 ohms when the fitting 30 is torqued into the spud 24 with approximately 30 foot pounds. It was found that the resistance went down when the torque was increased above 30 foot pounds and went up when the torque was decreased below 30 foot pounds. However, it is believed that by properly selecting the type and percentage of conductive particles or fibers relative to the polymeric material, any desired resistance can result, at a selected torque, such as the aforementioned 560 ohms utilized by the prior known heating elements that utilize an individual resistance element therewith.

The conductive polymeric material for the above test sample was obtained from AKZO Engineering Plastics, Inc. of Evansville, Ind., and is sold under their trademark "Electrafil".

While one arrangement for the electrically operated heating element construction 28 of this invention has been illustrated in FIGS. 1-7, it is to be understood that other arrangements can be provided.

For example, reference is now made to FIGS. 8-11 wherein another hot water tank construction of this invention is generally indicated by the reference numeral 20A and parts thereof similar to the hot water tank construction 20 previously described are indicated by like reference numerals followed by the reference letter "A".

As illustrated in FIGS. 8-11, the hot water tank 21A does not have an internally threaded spud 24 welded thereto in alignment with the opening 27A through the wall means 22A thereof as provided for the water heater for the hot water tank 21 previously described. Instead, a metallic plate 73 is utilized and the same has opposed flat sides 74 and 75 and is adapted to be bolted to the wall means 22A by a plurality of fastening members 75' passing through openings 76 in the plate 73 and aligned openings 77 in a sealing gasket means 78 and being received into threaded openings 79 formed through the wall means 22A so as to mount the plate 73 directly against the wall 22A in the manner illustrated in the drawings whereby the mounted plate 73 becomes part of the wall means 22A of the tank 21.

Figure 9:
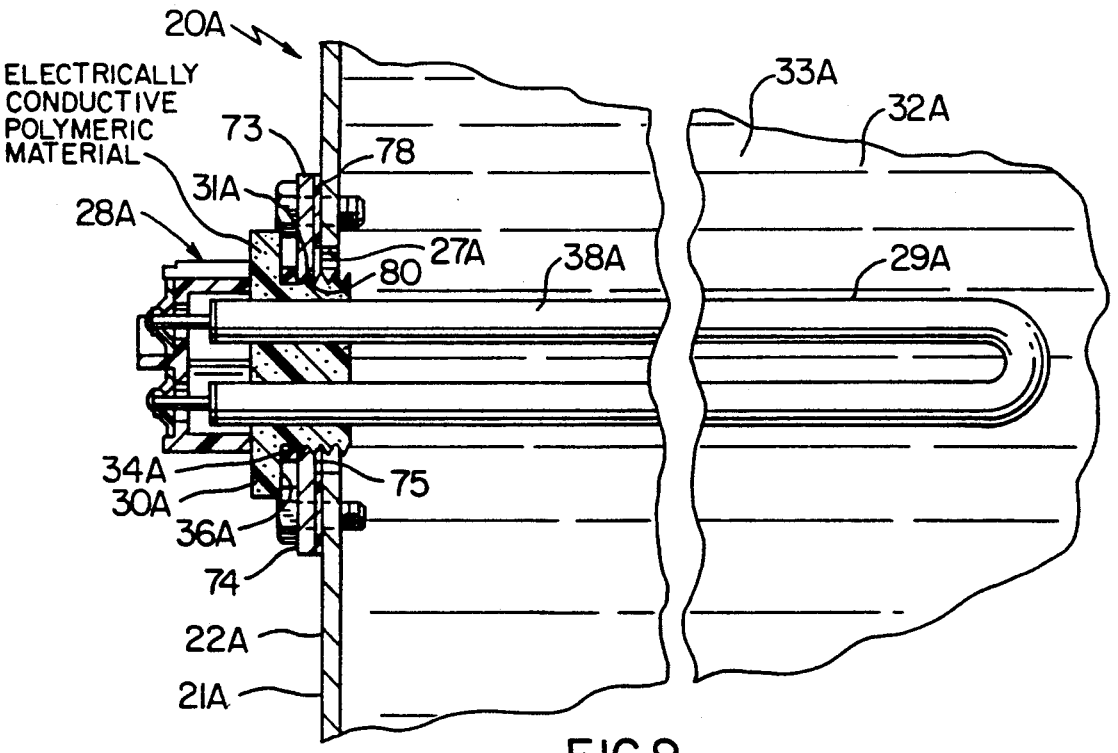
FIG. 9 is a fragmentary cross-sectional view taken on line 9—9 of FIG 8.
Figure 10:
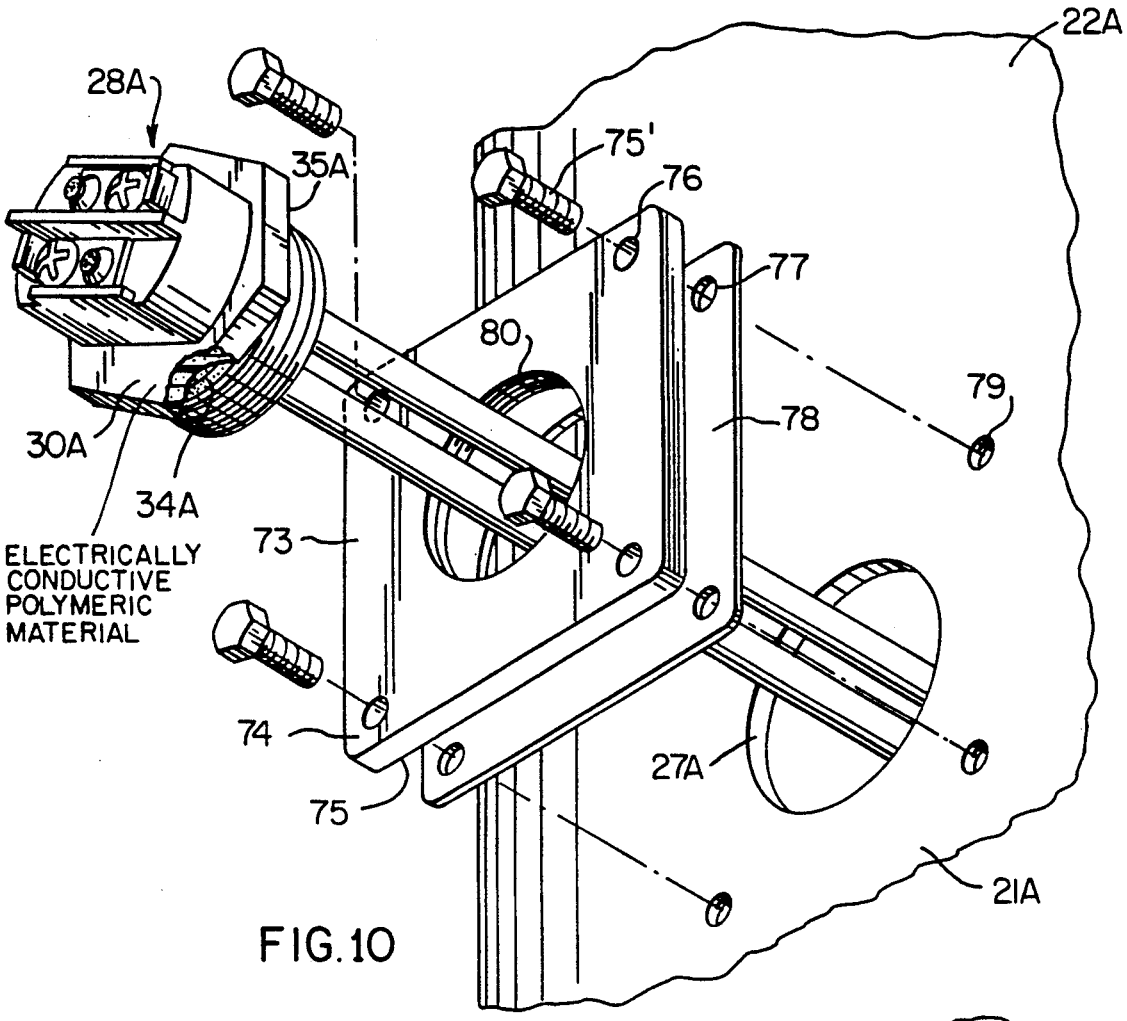
FIG. 10 is an exploded fragmentary perspective view of the various parts of the hot water tank construction of FIG. 8.
Figure 11:
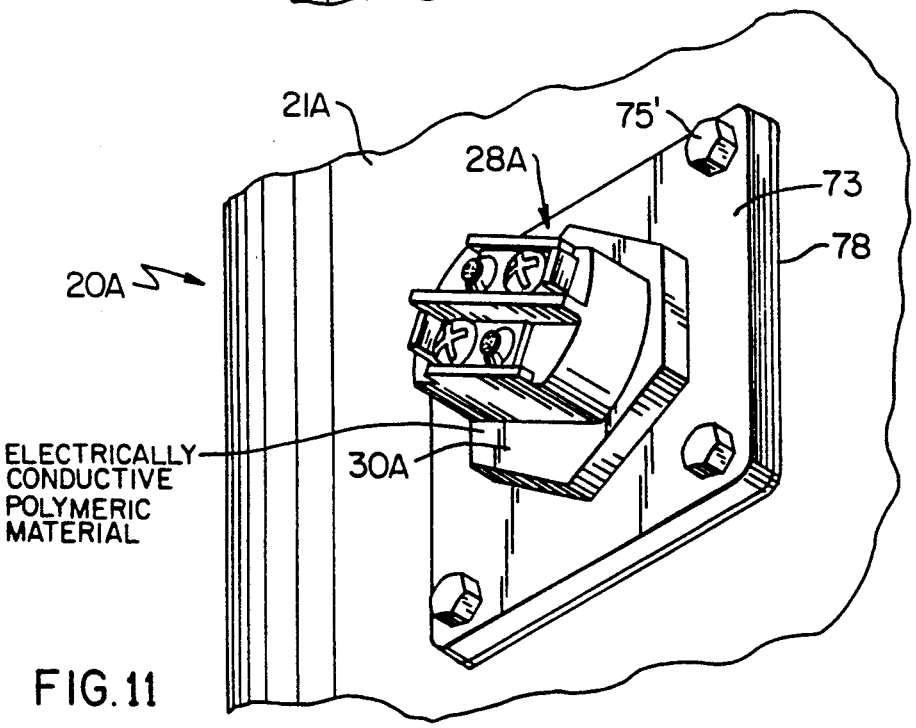
FIG. 11 is a fragmentary perspective view of the parts of FIG. 10 in their assembled relation.

The plate 73 has a central internally threaded opening 80 passing therethrough which is adapted to threadedly receive the externally threaded portion 31A of the fitting 30A of this invention in the manner illustrated in the drawings so that the electrically operated heating element construction 28A of this invention can be readily carried by the hot water tank 21A in the manner illustrated in FIG. 9 and have the threaded opening 80 through the plate 73 sealed by the gasket means 34A being compressed between the surface 36A of the fitting 30A and the front surface 74 of the plate 73 as illustrated in FIG. 9. In this manner, the electrically operated heating element construction 28A can be identical to the electrically operated heating element construction 28 previously described and be utilized with the mounting plate 73 rather than with the mounting spud 24 to be utilized in a manner to heat the water 32A in the chamber 33A of the tank 21A as previously set forth.

It can readily be seen that the fitting 30A of the electrically operated heating element construction 28A provides a resistance conductive path between the sheath 38A of the heating element 29A and the plate 73 while the plate provides a conductive path through the fastening members 75' to the wall means 22A of the tank 21A. Therefore, by forming the fitting 30A of the proper conductive polymeric material in the manner previously set forth, a desired resistance will be provided between the sheath 38A and the wall means 22A so that the resultant potential differential therebetween will aid in preventing corrosion not only of the sheath 28A of the element 29A, but also of the wall 22A for the reasons previously set forth.

Therefore, it can be seen that this invention not only provides a new hot water tank construction and a new electrically operated heating element construction therefor or the like, but also this invention provides new methods of making such a new hot water tank construction and such a new electrically operated heating element construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a method of making an electrically operated heating element construction for a hot water tank that has an internally threaded opening means in a wall means thereof, said construction comprising a heating element and an externally threaded fitting for threading into said opening means of said tank, said heating element comprising an outer metallic tubular sheath and an inner conductive heater wire means insulated from said sheath, said fitting comprising polymeric material, said construction comprising electrical resistance means electrically interconnected to said sheath and being adapted to electrically interconnect said sheath to said wall means of said tank, said polymeric material comprising an electrically conductive polymeric material that also comprises said resistance means of said construction, the improvement comprising the step of molding said externally threaded fitting from said electrically conductive polymeric material directly onto a previously deformed section of said outer metallic tubular sheath of said heating element to mechanically interconnect said heating element to said fitting.

2. A method of making an electrically operated heating element construction as set forth in claim 1 and comprising the step of forming said fitting to have a nut-shaped portion to facilitate threading said fitting into said threaded opening means of said wall means of said tank.

3. A method of making an electrically operated heating element construction as set forth in claim 1 and comprising the steps of forming said construction to comprise a flange member for being fastened to said wall means of said tank, and forming said flange member to have an internally threaded opening therethrough that is adapted to be aligned with an opening in said wall means of said tank whereby said threaded opening of said flange member comprises said threaded opening means of said wall means of said tank when said flange member is fastened to said wall means of said tank.

* * * * *